US009266165B2

(12) United States Patent
Dahl

(10) Patent No.: US 9,266,165 B2
(45) Date of Patent: Feb. 23, 2016

(54) METHOD FOR HOT FORGING THREADS INTO AN END OF A STEEL BAR

(71) Applicant: Christian L. Dahl, Newport Coast, CA (US)

(72) Inventor: Christian L. Dahl, Newport Coast, CA (US)

( * ) Notice: Subject to any disclaimer, the term of this patent is extended or adjusted under 35 U.S.C. 154(b) by 298 days.

(21) Appl. No.: 13/887,303

(22) Filed: May 4, 2013

(65) Prior Publication Data

US 2014/0325815 A1 Nov. 6, 2014

(51) Int. Cl.

| | |
|---|---|
| ***B21J 9/06*** | (2006.01) |
| ***B21K 1/56*** | (2006.01) |
| ***B21J 5/02*** | (2006.01) |
| ***B21J 5/08*** | (2006.01) |
| *B21J 9/08* | (2006.01) |

(52) U.S. Cl.

CPC . *B21K 1/56* (2013.01); *B21J 5/022* (2013.01); *B21J 5/08* (2013.01); *B21J 9/06* (2013.01); *B21J 9/08* (2013.01); *Y10T 29/49826* (2015.01)

(58) Field of Classification Search

CPC ..... B21C 37/04; B21C 37/045; B21D 19/08; B21D 22/022; B21J 5/02; B21J 5/022; B21J 5/025; B21K 1/56; Y10T 29/49403; Y10T 29/49805; Y10T 29/4998; Y10T 29/5116; Y10T 29/5121

See application file for complete search history.

(56) References Cited

U.S. PATENT DOCUMENTS

| | | | | |
|---|---|---|---|---|
| 5,606,887 | A * | 3/1997 | Spiegelberg | B21D 28/28 72/354.6 |
| 2005/0050843 | A1* | 3/2005 | Colarusso et al. | 52/749.1 |
| 2010/0048309 | A1* | 2/2010 | Gensert | 470/10 |
| 2011/0185783 | A1* | 8/2011 | Gensert | 72/256 |

* cited by examiner

*Primary Examiner* — Christopher Besler
(74) *Attorney, Agent, or Firm* — Morland C. Fischer

(57) ABSTRACT

A method for hot forging at least one end of a steel reinforcing bar (i.e., a rebar) to simultaneously form a wide head and threads funning around the head during a single step whereby to enable the bar to be coupled end-to-end an adjacent steel bar to be used, for example, to reinforce a precast concrete structure. The end of the bar is first preheated, and the heated end is surrounded by a closing die having a threaded geometry. The die is then nested within and closed around the heated end by an annulus ring of a hydraulic press, or the like. A hydraulic ram of the press is moved through the annulus ring and into engagement with the heated end of the rod so as to apply a compressive force thereto. The metal of the heated end flows into the die so as to be enlarged therein and assume the threaded geometry of the die.

6 Claims, 2 Drawing Sheets

METHOD FOR HOT FORGING THREADS INTO AN END OF A STEEL BAR

BACKGROUND OF THE INVENTION

1. Field of the Invention

The invention relates to a method for hot forging at least one end of a steel reinforcing bar (commonly referred to as a rebar), or the like, so as to form an enlarged threaded head during a single step. The threaded head of the rebar is adapted to be connected to an opposing threaded rebar by means of a suitable threaded coupler to be used, for example, to reinforce a precast concrete structure.

2. Background Art

From time-to-time, it becomes necessary to connect one steel bar to another. By way of example, in the case of concrete construction or repair, a plurality of steel reinforcing bars are connected end-to-end to be embedded within a precast concrete structure to enhance the strength of the structure and enable the structure to avoid shifting relative to an adjacent structure and better withstand the effects of an earthquake and other natural forces. Opposite ends of a pair of axially-aligned rebars are connected together by means of a coupler located therebetween. In this case, the opposing ends of the rebars to be connected together are threaded during a cold working process by either rolling or cutting the threads into the bars. The threaded ends of the rebars are rotated into mating engagement with a correspondingly threaded coupler. To maximize the cross-sectional (i.e., tensile) property of the bars, the threaded end of each can be enlarged prior to threading by either one of an independent cold or hot forming or forging step. In this case, the bar is provided with a relatively wide upset head often known in the art as a button or mushroom head.

It would be desirable to combine the advantages of upsetting and threading one or both ends of a rebar or the like during an efficient one-step process so as to eliminate the need to perform the separate and time-consuming independent steps in the manner described above.

SUMMARY OF THE INVENTION

Briefly, and in general terms, a method is disclosed for hot forging at least one end of a steel reinforcing bar (i.e., a rebar) or the like so as to form an enlarged threaded head during a single step. By virtue of the foregoing, the rebar can be headed without being subjected to the conventional inefficient and independent steps of first upsetting the rebar and then cold-working the upset end by rolling or cutting threads there within. A rebar having an end which is both enlarged and threaded according to the method herein disclosed can be connected end-to-end an adjacent axially-aligned similar rebar by rotating the opposing threaded ends of the rebars into mating engagement with a correspondingly threaded coupler located therebetween.

According to a preferred embodiment, one end of a rebar to be treated during a hot forging method is preheated to a temperature of about 2000° F. A clamp grips the rebar to prevent a displacement thereof during the hot forging method. The preheated end is located inside a pair of conical closing dies that are dimensioned to permit expansion and provide the heated end with a clearly defined threaded geometry. By way of example, a hydraulic press moves towards and generates a pushing force to compress the preheated end for causing the metal to flow into threaded cavities within the dies so as to assume the threaded geometry thereof. That is, with the dies closed around the rebar, a ram from the hydraulic press moves against and applies a pushing force to the pre-heated end. Accordingly, the preheated end is simultaneously compressed, shortened, widened and threaded to match the geometry of the die cavities. At the conclusion of the hot forging step just explained, the rebar is provided with an enlarged (i.e., widened) head having a series of threads running therearound, whereby the rebar is adapted to be mated to a suitable coupler for end-to-end connection to an adjacent rebar to be used, for example, to reinforce a concrete structure.

DESCRIPTION OF THE PREFERRED EMBODIMENT

Figure 1:
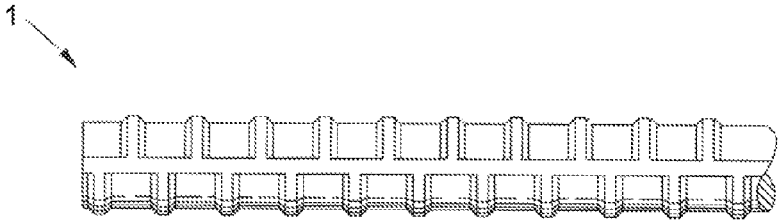
FIG. 1 (Prior Art)
FIG. 1 shows a conventional rebar of the kind used to reinforce a concrete structure.

FIG. 1 of the drawings shows a conventional steel reinforcement bar 1 (commonly known as a rebar). The rebar 1 is of the kind to be embedded within a reinforced concrete structure (e.g., a wall a panel, or the like) or connected between existing and adjacent reinforced concrete structures. A plurality of such rebars connected end-to-end one another enable a new structure to be built or an adjacent structure to be added to an existing structure. As a result of interconnecting a plurality of re-bars like that shown in FIG. 1, the reinforced structure or structures are less likely to shift (e.g., during an earthquake) so that their ability to avoid degradation and the necessity for an early repair will be enhanced.

Figure 2:
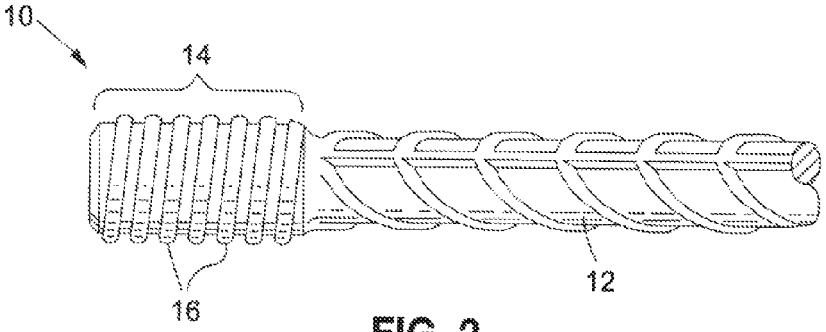
FIG. 2 shows a rebar having a wide and threaded head at one end thereof following a hot forging method according to a preferred embodiment of the present invention.

In accordance with the present improvement, in order to connect the opposing ends of a pair of adjacent and axially-aligned rebars or any other bars that are similar thereto, the ends of the rebars are enlarged (i.e., widened) to maximize their tensile strength and threaded during a single hot forging step. Referring in this regard to FIG. 2 of the drawings, a rebar 10 is shown after at least one end thereof has been enlarged and threaded. By virtue of the foregoing, the rebar 10 can be quickly and reliably connected by mans of a suitable threaded, coupler (designated 30 in FIG. 3) end-to-end an adjacent rebar.

The rebar 10 of FIG. 2 is shown having an elongated cylindrical body 12. In the preferred embodiment, a first end of the rebar 10 is subjected to a hot forging step, whereby to create an enlarged head 14 having a series of threads 16 running therearound. Depending upon the application and location of the rebar 10, either one or both ends can be enlarged and threaded. The number of threads 16 formed in the head 14 of rebar 10 can vary depending upon application. While the diameter of the enlarged head 14 can also vary, increasing the diameter will correspondingly increase the load capacity of the rebar 10. The diameter of the enlarged head 14 should be bigger (i.e., wider) than the diameter of the cylindrical body 12 so that the rebar 10 can be efficiently coupled to m adjacent and axially-aligned rebar (designated 20 in FIG. 3).

Figure 3:
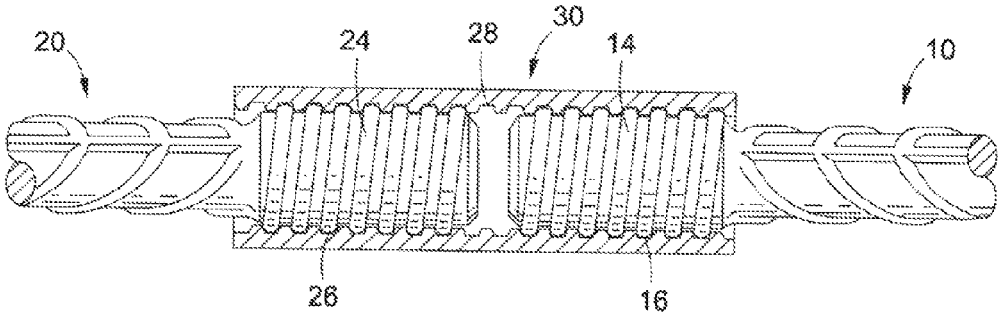
FIG. 3 shows a pair of rebars like that shown in FIG. 2 connected end-to-end one another by means of a coupler located therebetween.

To this end, FIG. 3 of the drawings shows a pair of rebars 10 and 20, each having an enlarged head 14 and 24 with a number of threads 16 and 26 formed therewithin. The enlarged and threaded heads 14 and 24 of the rebars 10 and 20 are rotated into mating engagement with a correspondingly threaded cylindrical bore 28 of a coupler 30 such that the rebars are connected end-to-end one another. In this same regard, the enlarged threaded head (e.g., 14) of the rebar 10 can be coupled to a variety of other connectors or fittings, such as end bearing anchors, nuts, etc.

Figure 4:
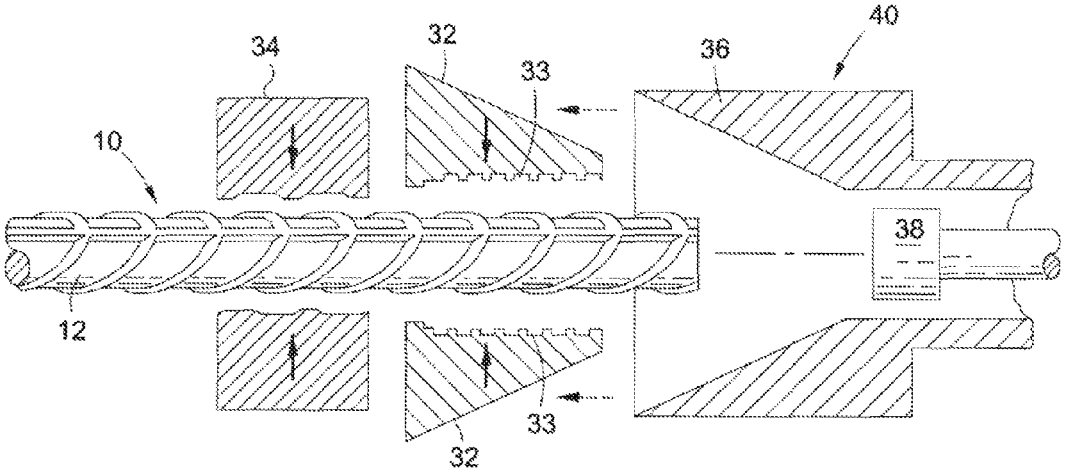
FIGS. 4 and 5 illustrate a preheated end of a rebar during the hot forging method of this invention to produce an enlarged head having threads formed therewithin so as to be suitable for coupling to an adjacent rebar.
Figure 5:
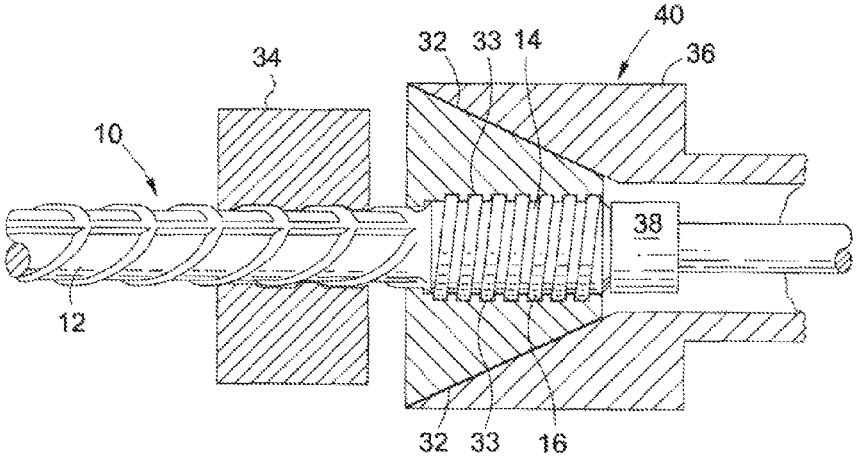

A preferred method for making the enlarged head 14 and the threads 16 formed therein at one end of the rebar 10 of FIG. 2 during a single step is now described. As opposed to the conventional sequential and independent upsetting and cold-working threading steps, the rebar 10 is subjected to a single hot forging step. In this case, and referring now to FIGS. 4 and 5 of the drawings, the end of rebar 10 to be treated is first preheated to a temperature of about 2000° F. at which the rebar will melt. Any suitable heating source, such as an induction or gas source, can be used for this purpose. The end of the rebar body 12 which lies opposite the heated end is gripped and held stationary by a clamp 34, or the like. The heated end of the rebar 10 is then located inside a pair of corneal closing dies 32. Each die 32 has a cavity 33 that is dimensioned to permit an expansion of the heated end in response to a compressive force and provide the heated end with a clearly defined threaded geometry to enable the resulting enlarged head 14 (best shown in FIG. 5) to be mated to a coupler, fitting or connector such as that designated 30 in FIG. 3.

A conventional hydraulic press 40 may be used to generate a pushing force to be applied to and compress the preheated end of the rebar 10 and thereby cause the metal to flow into the cavities 33 of the dies 32 and assume the threaded geometry thereof. More particularly, the hydraulic press 40 moves towards the rebar 10 until the conical dies 32 are nested within and embraced by a conical annulus ring 36 of the press, whereby the dies are automatically closed around the preheated end. A hydraulic ram 38 is then moved axially through the annulus ring 36 towards the rebar 10. With the body 12 of the rebar 10 being held stationary by the clamp 34, the axial pushing force applied by the ram 38 causes the preheated end to be simultaneously compressed, shortened, widened and threaded to match the geometry of the threaded cavities 33 of dies 32. By virtue of the foregoing, the rebar 10 is provided with an enlarged head 14 having a series of threads 16 formed therein as shown in FIG. 2 without having to cut or roll the threads into the rebar daring a separate cold working step.

The ram 38 is now withdrawn and the pushing force against the enlarged head 14 is terminated. The pair of dies 32 opens, and the clamp 34 releases its grip of the rebar body 12. Once it cools, the enlarged and threaded rebar 10 will be ready for use in reinforced concrete construction as described above as well as for any other application in which steel reinforcing bars or similar bars are to be connected to one another.

The invention claimed is:

1. A method for hot forging a first end of a solid steel rod having first and opposite ends to enable the first end to be enlarged for being coupled to an adjacent steel rod, said method including steps of:

heating the first end of the said steel rod;

surrounding the heated first end of the solid steel rod by a die within which said heated first end is located, said die including a pair of die members, each of said die members being spaced from one another and containing a threaded recess;

moving said pair of spaced die members together around the heated first end of said solid steel rod;

applying an axial pushing force towards said die and against the heated first end of the solid steel rod for compressing said heated first end and causing said heated first end to expand radially within said die to thereby create an enlarged head within the threaded recesses of said pair of die members relative to the opposite end of said solid steel rod so that the threads of the threaded recesses of said pair of die members are imparted to the enlarged head, such that said heated first end is simultaneously threaded and enlarged within the die by the threaded recesses contained by said pair of die members; and removing the enlarged first end of the solid steel rod from said die and permitting the threads imparted to said first end to cool.

2. The method for hot forging recited in claim 1, wherein each die member of the pair of spaced die members of said die is conical, said method including the additional step of locating said die within a press having a conical annulus ring such that the pair of spaced conical die members are embraced by said conical annulus ring for moving said pair of spaced conical die members together around the heated first end of the solid steel rod.

3. The method for hot forging recited in claim 2, wherein said press also has a movable ram, said method including an additional step of moving said ram in an axial direction towards the conical annulus ring of said press and into contact with the heated first end of said solid steel rod for applying said axial pushing force against and compressing said heated first end.

4. The method for hot forging recited in claim 3, including an additional step of gripping and holding the opposite end of the solid steel rod to resist a displacement of said solid steel rod during the step of moving said ram in an axial direction towards the conical annulus ring of said press and into contact with the heated first end of said solid steel rod for applying said axial pushing force against and compressing said heated first end.

5. The method for hot forging recited in claim 1, wherein said solid steel rod is a rebar.

6. A method for hot forging and enlarging a first end of a first solid steel rod having first and opposite ends and coupling the enlarged first end of the first solid steel rod to an adjacent solid steel rod, said method including steps of:

heating the first end of the first solid steel rod;

surrounding the heated first end of the first solid steel rod by a die within which said heated first end is located, said die including a pair of die members, each of said die members being spaced from one another and containing a threaded recess;

moving said pair of spaced die members together around the heated first end of said solid steel rod;

applying an axial pushing force towards said die and against the heated first end of the first solid steel rod for compressing said heated first end and causing said heated first end to expand radially within said die to thereby create an enlarged head within the threaded recesses of said pair of die members relative to the opposite end of said first solid steel rod so that the threads of the threaded recesses of said pair of die members are imparted to the enlarged head, such that said heated first end is simultaneously threaded and enlarged within the die by the threaded recesses contained by said pair of die members;

removing the enlarged first end of the first solid steel rod from said die and permitting the threads imparted to said first end to cool; and attaching a first threaded end of a coupler having first and opposite threaded ends to the threads of the enlarged head of the first solid steel rod, and attaching the opposite threaded end of the coupler to the adjacent solid steel rod.

* * * * *